US006363625B1

(12) United States Patent
Niemi

(10) Patent No.: US 6,363,625 B1
(45) Date of Patent: Apr. 2, 2002

(54) MULTIPLE DRUM MIXING SYSTEM

(75) Inventor: Walter Niemi, Quesnel (CA)

(73) Assignee: Niew Industries Inc., Prince George (CA)

( * ) Notice: Subject to any disclaimer, the term of this patent is extended or adjusted under 35 U.S.C. 154(b) by 0 days.

(21) Appl. No.: 09/423,790

(22) PCT Filed: Mar. 5, 1999

(86) PCT No.: PCT/CA99/00196

§ 371 Date: Nov. 12, 1999

§ 102(e) Date: Nov. 12, 1999

(87) PCT Pub. No.: WO99/46445

PCT Pub. Date: Sep. 16, 1999

(30) Foreign Application Priority Data

Mar. 10, 1998 (CA) ..... 2231693
Jul. 10, 1998 (CA) ..... 2243132

(51) Int. Cl.[7] ..... F26B 19/00

(52) U.S. Cl. ..... 34/136; 34/218; 34/231; 110/226; 366/24; 366/54; 432/106

(58) Field of Search ..... 34/135, 136, 179, 34/180, 181, 182, 183, 184, 209, 210, 218, 231; 366/7, 12, 14, 22, 24, 25, 54; 110/224, 226, 227, 246; 432/106, 107, 108

(56) References Cited

U.S. PATENT DOCUMENTS 4,376,343 A * 3/1983 White et al. ..... 34/109
4,600,379 A * 7/1986 Elliott ..... 432/13
6,196,710 B1 * 3/2001 Swanson et al. ..... 366/7

FOREIGN PATENT DOCUMENTS

DE 27 25 337 A1 12/1978

* cited by examiner

*Primary Examiner*—Pamela Wilson
(74) *Attorney, Agent, or Firm*—Adams, Schwartz & Evans, P.A.

(57) ABSTRACT

A drying and mixing plant is provided comprising a tapered inner drum (1) and an oppositely tapered outer drum (4) attached together concentrically and rotated as a unit. A burner (37) directs a hot air stream into the small end (2) of the inner drum (1). Material is fed into the small end of the inner drum, where impellers (40) lift it and drop it into the hot air stream and move the material through the inner drum (1) aided by the downward taper of the inner drum. The material exits the inner drum and enters the outer drum (4) where an additive material is introduced and mixed with the material (42) as both move through the chamber (28) between the inner and outer drums to a material outlet. The receiving end (5) of the outer drum (4) is enclosed in a shroud (12), therefore the air stream is directed through the chamber (28) between the drums, the chamber having an expanding cross section which slows the air down allowing fines to precipitate out. The device may include nozzles (17) for spraying water across the path of the air stream and material flow, and further may include, for fluid additive materials, additive nozzles (21, 23) spraying the additive material across the path of the air and material. A third drum (43) may be provided inside the inner drum (1), allowing separate addition of a third material (47), and further reducing fines in the air. The device is particularly suitable for mixing asphalt paving mix.

18 Claims, 4 Drawing Sheets

SECTION AA

MULTIPLE DRUM MIXING SYSTEM

This application is a national stage application, according to Chapter I of the Patent Cooperation Treaty. This application claims the priority date of Mar. 10, 1998 of Canadian Patent Application No. 2,231,693 and Jul. 10, 1998 of Canadian Patent Application No. 2,243,132.

This invention deals with the field of mixing plants and in particular such a plant that employs an inner and an outer drum rotating together.

BACKGROUND TO THE INVENTION

Various situations arise in industry where a material is dried and then mixed with another material. One example is where aggregate is dried and then mixed with cement for bagging as concrete mix. Another is where aggregate is dried and then mixed with liquid asphalt to produce an asphalt mixture for paving roads.

An asphalt plant is used to prepare the asphalt mix. Conventionally such plants comprise a is rotating drum set up at an angle to the horizontal. A burner and fan are located adjacent to the high end directing a flow of hot air into the high end of the drum. Aggregate is conveyed into the high end, and is carried towards the low end by gravity and the rotation of the drum which has impellers on its inner surface. The aggregate is tumbled in the hot air flow by the rotation of the drum and the impellers lifting the aggregate and dropping it into the air stream, essentially drying and heating the aggregate.

Approximately two thirds of the way down the drum, a flow of hot liquid asphalt is introduced to the aggregate. The impellers on the drum carry the aggregate and liquid asphalt towards the top of the drum, assisting the mixing process. At the end of the drum, the finished mix is discharged onto a conveyor by paddles. The hot air is exhausted from the lower end of the drum into a filter to remove the considerable amount of dust that is carried in the exhaust air.

A significant problem with such systems is that the fine material carried out with the air not only causes pollution, but the fines are also lost from the mix. These fines are material that has been conveyed into the mixer and dried. Any such material that does not go into the mix is a loss, and must be replaced with further aggregate material, at added cost.

A second significant problem with conventional drum mixers is that the liquid asphalt is exposed to very high temperatures in the drum which causes burning of the asphalt and degrades the quality of the finished product.

Prior U.S. Pat. No. 4,600,379 to Elliot is directed to a mixer with concentric dual drums. In the Elliot device, the dual drums are further contained in a shroud to capture unburned vapours from the exhaust air for re-burning. The Elliot device provides some mechanism for removing the dust from the exhaust air for retention in the mix and removes the flow of asphalt from the direct heat of the burner. In the Elliot device the hot air is removed directly from the inner drum, requiring a further housing around the outside drum to contain the air stream and attempt to expand it to precipitate the fine material.

Since the aggregate must move in both directions in the Elliot device the drums must be kept horizontal, and that device provides only impellers to actually move the aggregate through the device, requiring aggressive impellers leading to excessive wear and possible plugging. Similar limitations apply to the device of U.S. Pat. No. 4,262,429 to Avril. It would be desirable to provide a mixer which would allow gravity to aid in moving the material through the device.

Some studies show that mixing the hot aggregate with a small amount of water before the liquid asphalt is added will also improve the quality of an asphalt mix. After heating, the surface of the aggregate rock is very dry and the addition of a small amount of water to the surface of the rock helps the liquid asphalt to adhere to and penetrate the rock.

Usually an asphalt plant is set up near where the road paving is needed, reducing the distance that the finished product must be hauled. As the asphalt must be laid on the road at a certain minimum temperature, trucking distances from the plant must be kept to a minimum. It is desirable to have a mixing plant that lends itself readily to mounting on a trailer for easy movement.

SUMMARY OF THE INVENTION

It is an object of the present invention to provide a drying and mixing plant that captures the fine aggregate material usually carried out of the plant by the exhaust air, for use and retention in the material mix, thereby also reducing the filtration capacity needed to remove these fines from the air.

It is a further object of the present invention to provide such a drying and mixing plant that provides an improved mix for certain materials, such as an asphalt/aggregate mix, by moving the second material input "around the corner" from the burner, reducing burning of the second material.

It is a further object of the present invention to provide such a drying and mixing plant that provides an improved mix for certain materials, such as an asphalt/aggregate mix, by wetting the aggregate before it is mixed with the asphalt.

It is a further object of the present invention to provide such a drying and mixing plant that provides for separate introduction of a third material into the drying and mixing plant.

It is a further object of the present invention to provide an asphalt mixing plant that provides an improved asphalt mix by moving the asphalt injection nozzle "around the corner" from the burner, reducing burning of the asphalt or by wetting the aggregate before it is mixed with the asphalt or by a combination of both.

The invention accomplishes these objects providing in one aspect a drying and mixing plant for mixing material with an additive comprising an inner drum having an input end for receiving material and an output end for discharging material, said inner drum being tapered such that the diameter of said input end is smaller than the diameter of said output end; an outer drum concentric to said inner drum and attached to said inner drum so as to rotate in concert with said inner drum, said attachment such that there is an open chamber between said inner and outer drums, the resulting inner and outer drum assembly rotatably mounted on a frame so that the axis of said drums is approximately horizontal; a drive mechanism adapted to rotate said drum assembly; said outer drum having an input end for receiving material from said output end of the inner drum, and an output end at the opposite end thereof for discharging said material, said outer drum being tapered such that the diameter of said input end is smaller than the diameter of said output end; a first shroud enclosing said input end of the outer drum; a second shroud operatively connected to said chamber at the output end of the outer drum, said second shroud directing exhaust air to an exhaust air duct, and said second shroud further directing the mixed material to a material outlet: a burner and blower directing a stream of hot air into said input end of the inner drum, said hot air thereby moving through said inner drum; thence through said chamber and thence through said exhaust air duct: an additive material input for introducing an additive material into said material after said material leaves said output end of the inner drum; impellers attached to the inner surfaces of said inner and outer drums for lifting said material towards the lop of said drums and dropping same into said air stream, and for moving said material through said drums.

For fluid additive materials, a fluid additive material input could include a plurality of fluid additive nozzles located in proximity to the entrance to the chamber, the nozzles oriented to direct a spray of fluid additive across a majority of the cross-section of the chamber.

To improve adhesion and penetration of certain additives into the material, for example asphalt into aggregate, a water nozzle could be incorporated into the mixing plant for spraying water onto the material prior to introducing the asphalt. Such spraying with water would also help to precipitate the fines from the air stream, even should the additive material not be aided in adhesion and penetration by the addition of water. Preferably a plurality of water nozzles could direct a spray of water across a majority of the cross-section of said output end of the inner drum, thereby contacting the majority of the material and air stream.

In order to help control the air flow, the material outlet from the second shroud could be an air blocking material outlet, preventing air from leaving or entering the shroud through the outlet.

In a second aspect, the invention provides a drying and mixing plant for mixing a first material, a second material and an additive comprising a central drum having an input end for receiving a first material and an output end for discharging said first material, said central drum being tapered such that the diameter of said input end is smaller than the diameter of said output end; an inner drum having an input end for receiving a second material and an output end for discharging a mixture of said first and second materials, said inner drum being tapered such that the diameter of said input end is smaller than the diameter of said output end, said inner drum concentric to said central drum and attached to said central drum so as to rotate in concert with said central drum, said output end of said inner drum extending substantially beyond said output end of said central drum such that said first material leaving said output end of said central drum is received by said inner drum at a mid-point thereof, and will mix with said second material carried by said inner drum, prior to being discharged from said output end of said inner drum, said attachment such that there is an open middle chamber between said central and inner drums, said middle chamber being closed at that end nearest said input end of said inner drum, said closure providing access for the introduction of material into said middle chamber; an outer drum concentric to said inner and central drums and attached to said inner drum so as to rotate in concert with said inner and central drums, said attachment such that there is an open outer chamber between said inner and outer drums, the resulting central, inner and outer drum assembly rotatably mounted on a frame so that the axis of said drums is approximately horizontal; a drive mechanism adapted to rotate said drum assembly; said outer drum having an input end for receiving material from said output end of the inner drum, and an output end at the opposite end thereof for discharging said material, said outer drum being tapered such that the diameter of said input end is smaller than the diameter of said output end; a first shroud enclosing said input end of the outer drum; a second shroud operatively connected to said outer chamber at said output end of the outer drum, said second shroud directing exhaust air to an exhaust air duct, and said second shroud further directing the mixed material to a material outlet; a burner and blower directing a stream of hot air into said input end of the central drum, said hot air thereby moving through said central drum, thence through a portion of said inner drum, thence through said outer chamber and thence through said exhaust air duct; an additive material input for introducing an additive material into said mixture of first and second materials after said mixture leaves said output end of the inner drum; impeller attached to the inner surfaces of said central, inner and outer drums for lifting material towards the top of said drums and dropping same into said air stream, and for moving material through said drums.

The third drum is mounted inside the inner drum. The central and inner drums have essentially the same taper, with the central drum ending approximately halfway through the inner drum. This arrangement allows a first material to be introduced into the central drum with direct exposure to the hot air stream, such that it becomes very hot. A second material is introduced into the input end of the inner drum, and is heated by radiant heat from the surface of the central drum as it passes through the inner chamber. This second material is not directly exposed to the hot air stream until it reaches the end of the central drum, and may comprise the finer components of the mix. This arrangement will reduce the fines and dust in the air stream.

When the first material exits the central drum and falls into the second material part way down the inner drum, the hotter first material will also transfer heat to the cooler second material. Having two separate inputs for material also allows for easy adjustment of the proportions of the mix.

The above considerations and variations discussed for the two drum system also apply to the three drum system.

In a third aspect the invention provides an asphalt mixing plant comprising: an inner drum having an input end for receiving aggregate and an output end for discharging aggregate, said input end having a diameter smaller than the diameter of said output end; an outer drum having an input end for receiving aggregate from said output end of the inner drum and an output end for discharging said aggregate, said input end having a diameter smaller than the diameter of said output end; said drums being connected to each other concentrically such that aggregate discharged from said output end of the inner drum is received by said input end of the outer drum, said inner and outer drums thereby forming a drum assembly with an open chamber between said inner and outer drums, said chamber being essentially annular with an expanding cross-section, said drum assembly rotatably mounted on a frame such that the axes of said drums is substantially horizontal; a drive mechanism adapted to rotate said drum assembly; a first shroud enclosing said input end of the outer drum, a burner directing a hot air stream into said input end of the inner drum; an asphalt nozzle for spraying asphalt into said aggregate after said aggregate leaves said output end of said inner drum: a second shroud operatively connected to said chamber at the output end of the outer drum, said second shroud directing said air stream to an exhaust duct, and further directing said aggregate mixed with asphalt to a material outlet; and impellers on the inside surface of said inner and outer drums for moving the aggregate through said drums and further for lifting said aggregate and dropping said aggregate into said airstream.

In a fourth aspect the invention provides an asphalt mixing plant comprising: a central drum having an input end for receiving coarse aggregate from a first conveyor and an output end for discharging said coarse aggregate, said input end having a diameter smaller than the diameter of said output end; an inner drum having an input end for receiving fine aggregate from a second conveyor and an output end for discharging mixed fine and coarse aggregate, said input end having a diameter smaller than the diameter of said output end: an outer drum having an input end for receiving mixed fine and coarse aggregate from said output end of the inner drum and an output end for discharging mixed fine and coarse aggregate, said input end having a diameter smaller than the diameter of said output end; said drums being connected to each other concentrically such that coarse aggregate discharged from said output end of the central drum is received at a mid-point of said inner drum and mixed with said fine aggregate and such that mixed fine and coarse aggregate discharged from said output end of said inner drum is received by said input end of the outer drum, said central, inner and outer drums thereby forming a drum assembly with an open middle chamber between said central and inner drums, said middle chamber closed at that end nearest said input end of said inner drum, said closure providing access for the introduction of fine aggregate into said middle chamber, and also forming an outer chamber between said inner and outer drums, said outer chamber being essentially annular with an expanding cross-section, said drum assembly rotatably mounted on a frame such that the axes of said drums is substantially horizontal; a drive mechanism adapted to rotate said drum assembly; a first shroud enclosing said input end of the outer drum; a burner directing a hot air stream into said input end of the central drum; an asphalt nozzle for spraying asphalt into said mixed fine and coarse aggregate after said mixed fine and coarse aggregate leaves said output end of said inner drum; a second shroud operatively connected to said outer chamber at the output end of the outer drum, said second shroud directing said airstream to an exhaust duct, and further directing said mixed fine and coarse aggregate mixed with asphalt to a material outlet; and impellers on the inside surface of said central, inner and outer drums for moving the aggregate through said drums and further for lifting said aggregate and dropping said aggregate into said airstream.

In another embodiment, the invention provides an asphalt mixing plant comprising an inner drum having an input end for receiving aggregate and an output end for discharging aggregate, said input end having a diameter smaller than the diameter of said output end; an outer drum having an input end for receiving aggregate from said output end of the inner drum and an output end for discharging said aggregate, said input end having a diameter smaller than the diameter of said output end; said drums being connected to each other concentrically such that aggregate discharged from said output end of the inner drum is received by, aid input end of the outer drum, said inner and outer drums thereby forming a drum assembly with an open chamber between said inner and outer drums, said chamber being essentially annular with an expanding cross-section, said drum assembly rotatably mounted on a frame such that the axes of said drums is substantially horizontal, and said drum assembly driven rotationally by a drive means; a first shroud enclosing said input end of the outer drum; a burner directing a hot air stream into said input end of the inner drum, an asphalt nozzle for spraying asphalt into said aggregate after said aggregate leaves said output end of said inner drum; a second shroud operatively connected to said chamber at the output end of the outer drum, said second shroud directing said air stream to an exhaust duct, and further directing said aggregate mixed with asphalt to a material outlet; and impellers on the inside surface of said inner and outer drums for moving the aggregate through said drums and further for lifting said aggregate and dropping said aggregate into said airstream.

The asphalt nozzle could include a plurality of nozzles mounted on a ring member located in proximity to the entrance to the outer chamber, and the spray of asphalt directed across the majority of the cross-section of the chamber. A plurality of nozzles could be mounted on a ring member located in proximity to said entrance to said chamber, said ring member adjacent to the outside of said output end of the inner drum, and said spray of fluid additive directed across the cross-section of said chamber. A second ring member could be located in proximity to said first ring member, with a plurality of nozzles mounted thereon, said nozzles oriented to direct a spray of fluid additive across the cross-section of said chamber. Using two sets of nozzles, which would essentially overlap, ensures that the majority of the cross-section of said chamber could be covered with a spray of fluid additive material. Thus fines in the air stream could be coated. making them heavier and more likely to precipitate out of the air.

The embodiment could further include a disc fixedly attached to the frame and located in the output end of the inner drum such that the plane of the disc is perpendicular to the axis of the inner drum and the axis of the disc is coincidental with the axis of the inner drum, whereby the exit from the inner drum becomes an annular passage and wherein a plurality of water nozzles direct a spray of water across this annular passage. The water nozzles could be mounted on a ring member and the ring member mounted coaxially to said disc.

In the embodiment, the material outlet could be a vibrating type, air blocking material outlet.

The addition of the third drum in this asphalt mixing plant is analogous to the above description for the three drum drying and mixing plant, and similar considerations apply.

The present invention provides an inner and outer drum with opposing tapers so that the material is always moving "downhill" as it passes through the device. These tapers also provide an annular chamber between the drums which expands in the direction of air movement, which expansion reduces the air velocity, allowing the fine material to precipitate out of the air stream. This precipitation may be enhanced by spraying the asphalt across the whole of the cross-section of the annular chamber, thereby coating the fines in the air stream passing through the spray with asphalt. While the asphalt injection, unlike the Elliot device, takes place in the path of the total air stream from the burner, it has been moved far enough away from the direct flame to reduce burning of the asphalt.

The present invention in one embodiment provides a spray of water across the exit from the inner drum which slightly wets the aggregate and the air born fines. As well as improving the properties of the asphalt mix, this process of wetting the fines in the air helps to precipitate those fines out of the air.

The present invention is compact and lends itself readily to mounting on a trailer for easy movement.

It is contemplated that there are numerous other applications for the present invention, which could be utilized in any application where drying and mixing of two materials is required.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DESCRIPTION OF THE ILLUSTRATED EMBODIMENTS

Figure 1:
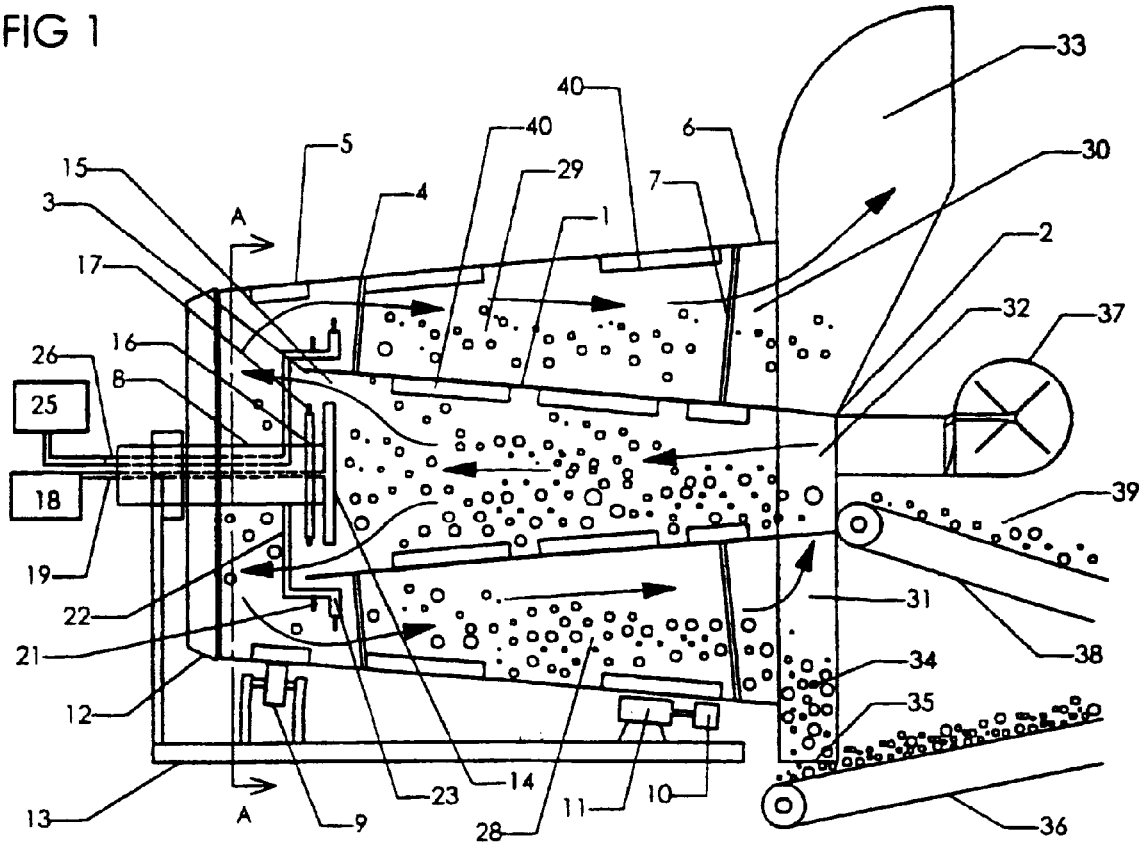
FIG. 1 is a cut-away side view of an embodiment for mixing asphalt and aggregate.
Figure 2:
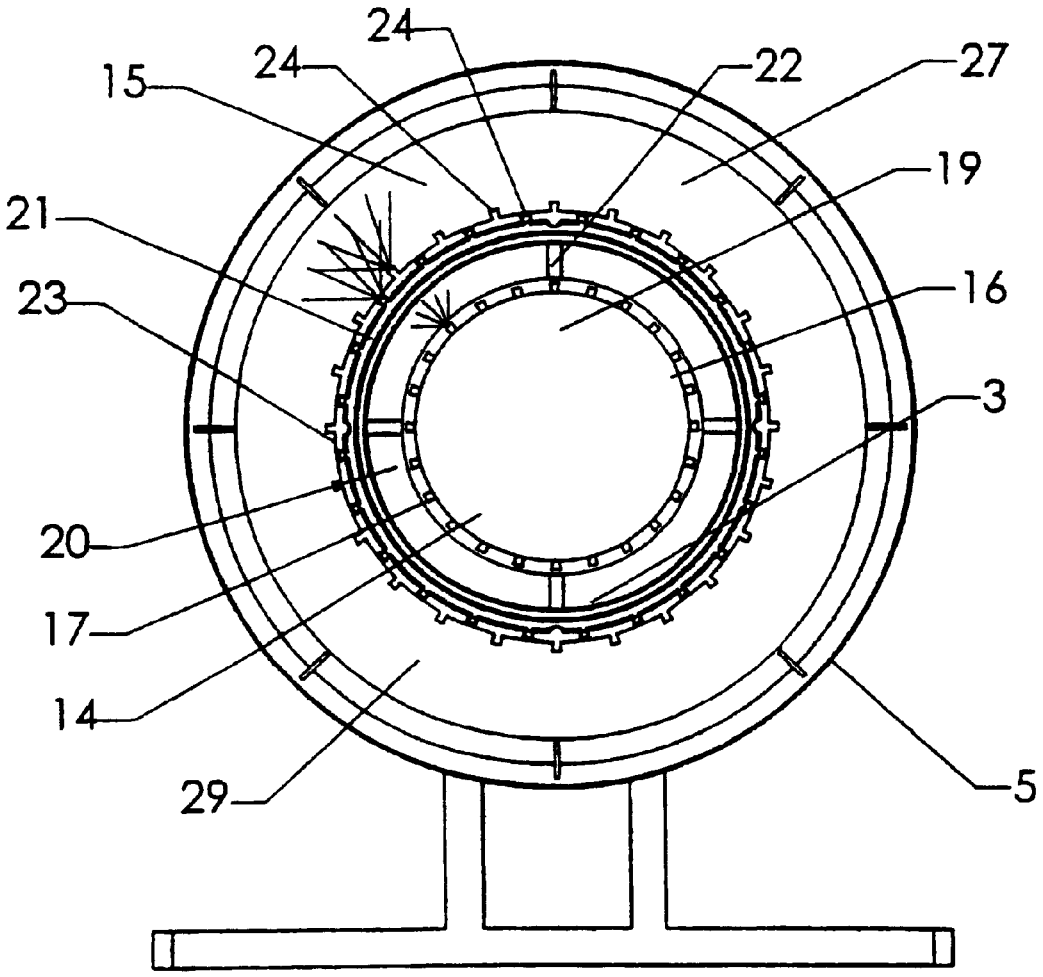
FIG. 2 is a cross-section along line AA in FIG. 1 showing the spray coverage of asphalt and water nozzles.

FIGS. 1 and 2 show one preferred embodiment of the invention designed for use where the material is aggregate and the additive material is liquid asphalt, providing an asphalt mixing plant.

FIG. 1 shows the inner drum 1, having an input end 2 and an output end 3, and the outer drum 4, having an input end 5 and an output end 6. The input end ends 2,5 are smaller in diameter than the output ends 3,6 of the respective drums 1,4. Outer drum shroud 12 encloses the input end 5 of the outer drum 4. The drums 1,4 are attached together by drum braces 7 to form a drum assembly which is supported on the lower frame 13 at drive wheel 10 and support wheels 9. Drive wheel 10 is rotationally driven by motor 11, and the drum assembly is thereby rotated. Disc 14 is supported on the end of the upper frame 8, partially inside the output end 3 of the inner drum 1, thus restricting that output end 3 such that all material and air must flow around the disc through an annular passage 15. Water nozzle ring 16 is a pipe formed into a circle and attached to the outside of the disc 14. Water nozzles 17 are mounted on water nozzle ring 16, and pressurized water from water source 18 is delivered through water pipe 19, running through upper frame 8, to water nozzles 17. The water spray 20 put forth from the water nozzles 17 substantially covers the annular passage 15 through which all material and air must pass. First asphalt nozzle ring 21 is held in place adjacent to the outside of the output end 3 of the inner drum 1 by asphalt nozzle ring braces 22. Second asphalt nozzle ring 23 is attached to first asphalt nozzle ring 21 and located adjacent thereto. Asphalt nozzles 24 are mounted on the two asphalt nozzle rings 21,23 and hot, pressurized liquid asphalt from the pressurized asphalt source 25 is delivered through asphalt pipe 26, running through upper frame 8 and one of the asphalt nozzle ring braces 22, to the asphalt nozzles 24. The asphalt spray 27 delivered by the two adjacent sets of asphalt nozzles 24 covers substantially the whole of the cross-section of the chamber 28. Similar to the annular passage 15, all material and air must pass through the chamber 28 and so through the asphalt spray 27.

The chamber 28 is an annular chamber with an expanding cross-section. The front end 29 of the chamber 28 has a much smaller cross-sectional area than the back end 30 of the chamber 28. The back end 30 is connected to a chamber shroud 31 which directs the air stream 32 to an exhaust outlet 33 at the top of the chamber shroud 31, and further collects the solid asphalt/aggregate mix 34 at its lower end where a vibrating outlet 35 delivers the asphalt/aggregate mix 34 to a mix conveyor 36 for carriage to trucks or storage as required.

In operation, burner/blower unit 37 delivers a hot air stream 32, indicated by the arrows in FIG. 1, into the inner drum 1. Aggregate conveyor 38 delivers aggregate 39 into the inner drum 1, where impellers 40, as are well known in the art, pick up the aggregate as the drum assembly rotates and drop it into the air stream 32, thereby heating and drying the aggregate 39. The aggregate 39 moves toward the output end 3 of the inner drum 1 in response to the action of the impellers 40 aided by gravity resulting from the downward taper of the inner drum 1.

Near the end of the inner drum 1, the air 32 and aggregate 39 must pass through the annular passage 15 and so through the water spray 20, which wets the aggregate 39 and the fines carried in the air stream 32. The aggregate 39 is received by the input end, of the outer drum 4 and reverses direction as the result of the impellers 40 on the inside surface of the outer drum 4, again aided by gravity as the result of the taper on the outer drum 4, to travel through the chamber 28 and through the asphalt spray 27, which coats the aggregate 39 and the fines carried in the airstream 32 with asphalt. The asphalt and aggregate 39 are further mixed as the materials pass through the chamber 28, and are thoroughly mixed by the time the asphalt/aggregate mix 34 is collected at the bottom of the chamber shroud 31 and delivered to the mix conveyor 36 by the vibrating outlet 35.

As the air stream travels through the chamber 28, it slows in response to the enlarging cross-section of the chamber 28, thereby allowing the fines, which have been wetted and coated with asphalt and thereby become heavier, to precipitate out and into the asphalt/aggregate mix 34. The air stream 32 enters the chamber shroud 31 at the back end 30 of the chamber 28 and is directed out of the mixer through an exhaust outlet 33 for further filtration or treatment as needed. No air can enter or leave the chamber shroud through the vibrating outlet 35, because of its air blocking properties. The asphalt/aggregate mix 34 piles up on the vibrating outlet 35, preventing any air escape.

Figure 3:
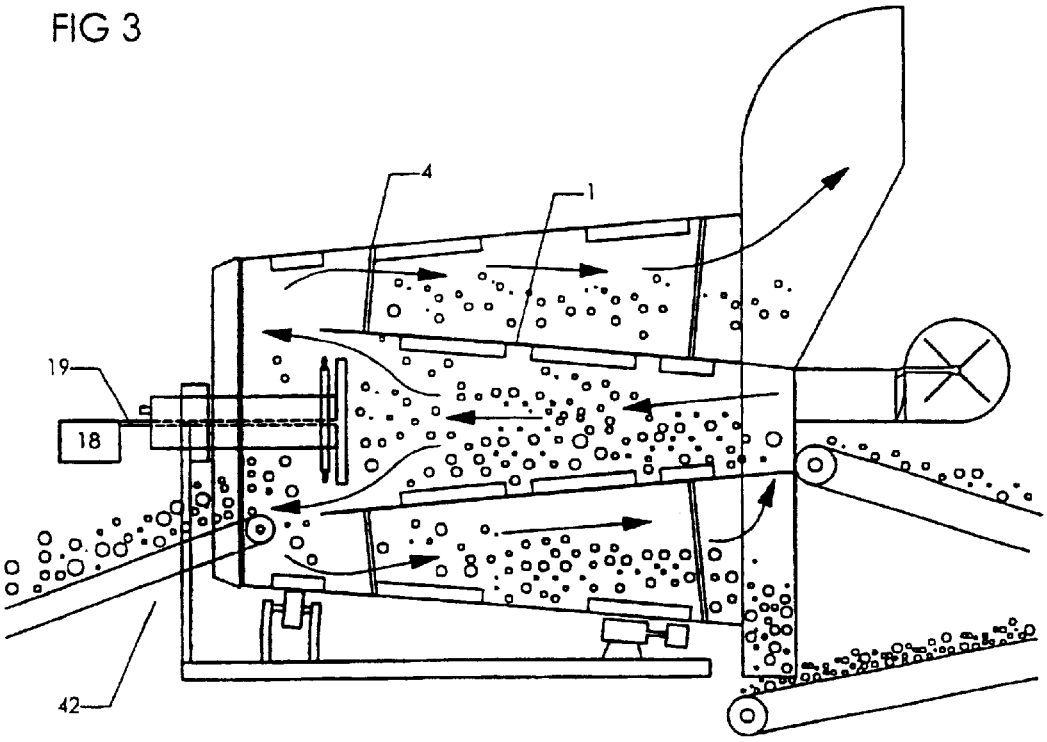
FIG. 3 is a cut-away side view of an embodiment for mixing two particulate materials.

FIG. 3 shows an alternate embodiment suitable for drying one particulate material and then mixing the same with another particulate material. The water nozzles 17 are used to help precipitate fines, however it is contemplated that such a device without the water nozzles would be useful as well in precipitating out more of the fines in the air stream than is presently possible. Particulate input 42 delivers the second particulate material to the input end 5 of the outer drum 4, entering the rotating drum assembly through the outer drum shroud 12. The mixing action and airstream action are the same as that previously described for the asphalt mixing plant.

Figure 4:
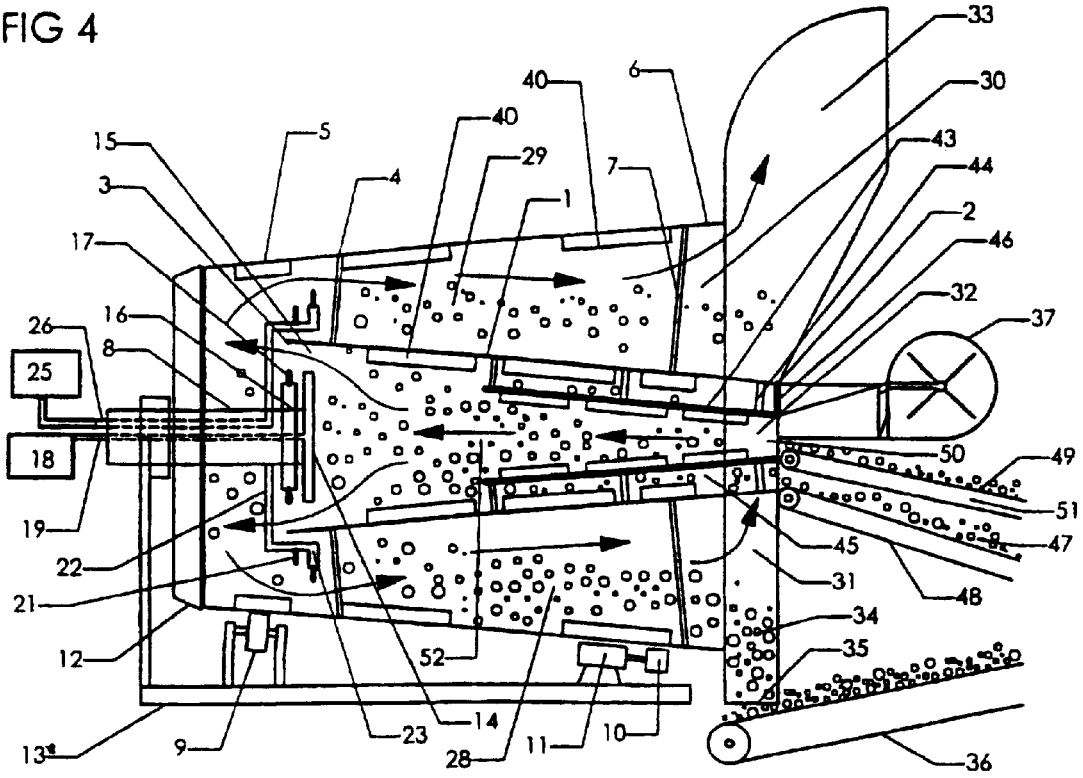
FIG. 4 is a cut-away side view of an embodiment comprising three drums.

FIG. 4 shows a triple drum embodiment being the double drum embodiment of FIG. 1 with the addition of a central drum 43 mounted to the inner drum 1 by central drum braces 44, so as to rotate with the inner drum 1 and outer drum 4. This central drum 43 extends slightly more than half way through the inner drum 1, and forms a middle chamber 45 between the central drum 43 and inner drum 1. This middle chamber 45 is closed at its input end 46, except for an access for fine aggregate 47 from a fine aggregate conveyor 48.

Coarse aggregate 49 is fed into the input end 50 of the central drum 43 by coarse aggregate conveyor 51. This coarse aggregate 49 is subjected to the direct, more confined hot air stream 32 and becomes very hot as it is raised by impellers 40 on the inside of the central drum 43 and drops through the hot air stream 32. The fine aggregate 47 passes through the middle chamber 45, where it is heated and dried by radiant heat from the outer surface of the central drum 43. There is little airflow through this middle chamber as it is substantially closed at its input end 46, and so the fines are not picked up by the air stream 32. At the output end 52 of the central drum 43, the coarse aggregate 49 drops into the inner drum 1 and mixes with the fine aggregate 47. This mixing transfers heat from the hotter coarse aggregate 49 to the cooler fine aggregate 47. At this point the finer material in the fine aggregate 47 is directly exposed to the hot air stream 32, however only for approximately half as long as in the double drum embodiment of FIG. 1. From this point on the operation is the same as described above for the embodiment of FIG. 1. This triple drum embodiment with a separate input for coarse and fine aggregate allows for easy adjustment of the proportions of each, and also reduces the fines carried in the air stream.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A drying and mixing plant for mixing material with an additive comprising:

(a) an inner drum having an input end for receiving material and an output end for discharging material, said inner drum being tapered such that the diameter of said input end is smaller than the diameter of said output end;

(b) an outer drum concentric to said inner drum and attached to said inner drum so as to rotate in concert with said inner drum, said attachment such that there is an open chamber between said inner and outer drums, the resulting inner and outer drum assembly rotatably mounted on a frame so that the axis of said drums is approximately horizontal;

(c) a drive mechanism adapted to rotate said drum assembly;

(d) said outer drum having an input end for receiving material from said output end of the inner drum, and an output end at the opposite end thereof for discharging said material, said outer drum being tapered such that the diameter of said input end is smaller than the diameter of said output end;

(e) a first shroud enclosing said input end of the outer drum;

(f) a second shroud operatively connected to said chamber at the output end of the outer drum, said second shroud directing exhaust air to an exhaust air duct, and said second shroud further directing the mixed material to a material outlet;

(g) a burner and blower directing a stream of hot air into said input end of the inner drum, said hot air thereby moving through said inner drum, thence through said chamber and thence through said exhaust air duct;

(h) an additive material input for introducing an additive material into said material after said material leaves said output end of the inner drum;

(i) impellers attached to the inner surfaces of said inner and outer drums for lifting said material towards the top of said drums and dropping same into said air stream, and for moving said material through said drums.

2. The invention of claim 1 wherein said additive material input comprises a plurality of fluid additive nozzles located in proximity to the entrance to said chamber, said nozzles oriented to direct a spray of fluid additive across a majority of the cross-section of said chamber.

3. The invention of claim 1 further comprising a water nozzle for spraying water onto said material prior to introducing said additive material.

4. The invention of claim 3 wherein said water nozzle comprises a plurality of water nozzles directing a spray of water across the majority of the cross-section of said output end of the inner drum.

5. The invention of claim 4 further comprising a disc fixedly attached to said frame, said disc located in said output end of the inner drum such that the plane of said disc is perpendicular to said axis of said inner drum and the axis of said disc is coincidental with said axis of said inner drum, whereby the exit from said inner drum becomes an annular passage and wherein said water nozzles direct a spray of water across said annular passage.

6. The invention of claim 1 wherein said material outlet from said second shroud is an air blocking material outlet, preventing air from leaving or entering said shroud through said material outlet.

7. A drying and mixing plant for mixing a first material, a second material and an additive comprising:

(a) a central drum having an input end for receiving a first material and an output end for discharging said first material, said central drum being tapered such that the diameter of said input end is smaller than the diameter of said output end;

(b) an inner drum having an input end for receiving a second material and an output end for discharging a mixture of said first and second materials, said inner drum being tapered such that the diameter of said input end is smaller than the diameter of said output end, said inner drum concentric to said central drum and attached to said central drum so as to rotate in concert with said central drum, said output end of said inner drum extending substantially beyond said output end of said central drum such that said first material leaving said output end of said central drum is received by said inner drum at a mid-point thereof, and will mix with said second material carried by said inner drum, prior to being discharged from said output end of said inner drum, said attachment such that there is an open middle chamber between said central and inner drums, said middle chamber being closed at that end nearest said input end of said inner drum, said closure providing access for the introduction of material into said middle chamber;

(c) an outer drum concentric to said inner and central drums and attached to said inner drum so as to rotate in concert with said inner and central drums, said attachment such that there is an open outer chamber between said inner and outer drums, the resulting central, inner and outer drum assembly rotatably mounted on a frame so that the axis of said drums is approximately horizontal;

(d) a drive mechanism adapted to rotate said drum assembly;

(e) said outer drum having an input end for receiving material from said output end of the inner drum, and an output end at the opposite end thereof for discharging said material, said outer drum being tapered such that the diameter of said input end is smaller than the diameter of said output end;

(f) a first shroud enclosing said input end of the outer drum;

(g) a second shroud operatively connected to said outer chamber at said output end of the outer drum, said second shroud directing exhaust air to an exhaust air duct, and said second shroud further directing the mixed material to a material outlet;

(h) a burner and blower directing a stream of hot air into said input end of the central drum, said hot air thereby moving through said central drum, thence through a portion of said inner drum, thence through said outer chamber and thence through said exhaust air duct;

(i) an additive material input for introducing an additive material into said mixture of first and second materials after said mixture leaves said output end of the inner drum;

(j) impellers attached to the inner surfaces of said central, inner and outer drums for lifting material towards the top of said drums and dropping same into said air stream, and for moving material through said drums.

8. The invention of claim 7 wherein said additive material input comprises a plurality of fluid additive nozzles located in proximity to the entrance to said chamber, said nozzles oriented to direct a spray of fluid additive across a majority of the cross-section of said chamber.

9. The invention of claim 7 further comprising a water nozzle for spraying water onto said material prior to introducing said additive material.

10. The invention of claim 7 wherein said material outlet from said second shroud is an air blocking material outlet, preventing air from leaving or entering said shroud through said material outlet.

11. An asphalt mixing plant comprising:

(a) an inner drum having an input end for receiving aggregate and an output end for discharging aggregate, said input end having a diameter smaller than the diameter of said output end;

(b) an outer drum having an input end for receiving aggregate from said output end of the inner drum and an output end for discharging said aggregate, said input end having a diameter smaller than the diameter of said output end;

(c) said drums being connected to each other concentrically such that aggregate discharged from said output end of the inner drum is received by said input end of the outer drum, said inner and outer drums thereby forming a drum assembly with an open chamber between said inner and outer drums, said chamber being essentially annular with an expanding cross-section, said drum assembly rotatably mounted on a frame such that the axes of said drums is substantially horizontal;

(d) a drive mechanism adapted to rotate said drum assembly;

(e) a first shroud enclosing said input end of the outer drum;

(f) a burner directing a hot air stream into said input end of the inner drum;

(g) an asphalt nozzle for spraying asphalt into said aggregate after said aggregate leaves said output end of said inner drum;

(h) a second shroud operatively connected to said chamber at the output end of the outer drum, said second shroud directing said air stream to an exhaust duct, and further directing said aggregate mixed with asphalt to a material outlet; and (i) impellers on the inside surface of said inner and outer drums for moving the aggregate through said drums and further for lifting said aggregate and dropping said aggregate into said airstream.

12. The invention of claim 11 wherein said asphalt nozzle comprises a plurality of nozzles mounted on a ring member located in proximity to the entrance to said outer chamber, and said spray of asphalt is directed across the majority of the cross-section of said outer chamber.

13. The invention of claim 12 further comprising a disc fixedly attached to said frame, said disc located in said output end of the inner drum such that the plane of said disc is perpendicular to said axis of said inner drum and the axis of said disc is coincidental with said axis of said inner drum, whereby the exit from said inner drum becomes an annular passage and wherein a plurality of water nozzles direct a spray of water across said annular passage.

14. The invention of claim 13 wherein said water nozzles are mounted on a ring member and wherein said ring member is mounted coaxially to said disc.

15. The invention of claim 11 wherein said material outlet is a vibrating type, air blocking material outlet.

16. An asphalt mixing plant comprising:

(a) a central drum having an input end for receiving coarse aggregate from a first conveyor and an output end for discharging said coarse aggregate, said input end having a diameter smaller than the diameter of said output end;

(b) an inner drum having an input end for receiving fine aggregate from a second conveyor and an output end for discharging mixed fine and coarse aggregate, said input end having a diameter smaller than the diameter of said output end;

(c) an outer drum having an input end for receiving mixed fine and coarse aggregate from said output end of the inner drum and an output end for discharging mixed fine and coarse aggregate, said input end having a diameter smaller than the diameter of said output end;

(d) said drums being connected to each other concentrically such that coarse aggregate discharged from said output end of the central drum is received at a midpoint of said inner drum and mixed with said fine aggregate and such that mixed fine and coarse aggregate discharged from said output end of said inner drum is received by said input end of the outer drum, said central, inner and outer drums thereby forming a drum assembly with an open middle chamber between said central and inner drums, said middle chamber closed at that end nearest said input end of said inner drum, said closure providing access for the introduction of fine aggregate into said middle chamber, and also forming an outer chamber between said inner and outer drums, said outer chamber being essentially annular with an expanding cross-section, said drum assembly rotatably mounted on a frame such that the axes of said drums is substantially horizontal;

(e) a drive mechanism adapted to rotate said drum assembly;

(f) a first shroud enclosing said input end of the outer drum;

(g) a burner directing a hot air stream into said input end of the central drum;

(h) an asphalt nozzle for spraying asphalt into said mixed fine and coarse aggregate after said mixed fine and coarse aggregate leaves said output end of said inner drum;

(i) a second shroud operatively connected to said outer chamber at the output end of the outer drum, said second shroud directing said air stream to an exhaust duct, and further directing said mixed fine and coarse aggregate mixed with asphalt to a material outlet; and (j) impellers on the inside surface of said central, inner and outer drums for moving the aggregate through said drums and further for lifting said aggregate and dropping said aggregate into said airstream.

17. The invention of claim 16 wherein said asphalt nozzle comprises a plurality of nozzles mounted on a ring member located in proximity to the entrance to said outer chamber, and said spray of asphalt is directed across the majority of the cross-section of said outer chamber.

18. The invention of claim 16 wherein said material outlet is a vibrating type, air blocking material outlet.

* * * * *